US007145117B2

(12) United States Patent
Ristola et al.

(10) Patent No.: US 7,145,117 B2
(45) Date of Patent: Dec. 5, 2006

(54) APPARATUS FOR HEATING A BOARD PRODUCT INCLUDING GLUED WOOD

(75) Inventors: Pete Ristola, Hollola (FI); Jaakko Vilo, Turku (FI)

(73) Assignee: Raute Oyj (FI)

( * ) Notice: Subject to any disclaimer, the term of this patent is extended or adjusted under 35 U.S.C. 154(b) by 0 days.

(21) Appl. No.: 10/991,519

(22) Filed: Nov. 19, 2004

(65) Prior Publication Data

US 2005/0127067 A1 Jun. 16, 2005

(30) Foreign Application Priority Data

Nov. 19, 2003 (FI) ..... 20031680

(51) Int. Cl.
*H05B 6/78* (2006.01)

(52) U.S. Cl. ..... 219/693; 156/275.5

(58) Field of Classification Search ..... 219/693, 219/690, 691, 698, 764; 156/273.7, 275.5, 156/580

See application file for complete search history.

(56) References Cited

U.S. PATENT DOCUMENTS 4,456,498 A 6/1984 Churchland
5,552,583 A * 9/1996 Berteaud et al. ..... 219/693
6,242,726 B1 6/2001 Harris et al.
6,287,410 B1 * 9/2001 Klemarewski ..... 156/273.7
6,744,025 B1 6/2004 Vilo
2004/0065982 A1 4/2004 Churchland et al.

FOREIGN PATENT DOCUMENTS

FI 112026 8/2003

OTHER PUBLICATIONS

Search Report dated May 28, 2004, No. 20031680, 3 pages.

* cited by examiner

*Primary Examiner*—Quang Van
(74) *Attorney, Agent, or Firm*—Connelly Bove Lodge & Hutz LLP

(57) ABSTRACT

An apparatus for heating a board product containing glued wood is disclosed. The apparatus includes a heating chamber through which the board product passes. The board product passes through a heating field in the heating chamber provided by means of microwave energy applied perpendicular to the board plane. The clearances between respective side edges of the board and side walls of the heating apparatus are filled by slide pieces made of a material that has a small loss tangent and a low dielectric factor. The slide pieces correct the form of the heating field affecting the board plane.

11 Claims, 2 Drawing Sheets

APPARATUS FOR HEATING A BOARD PRODUCT INCLUDING GLUED WOOD

Figure 1:
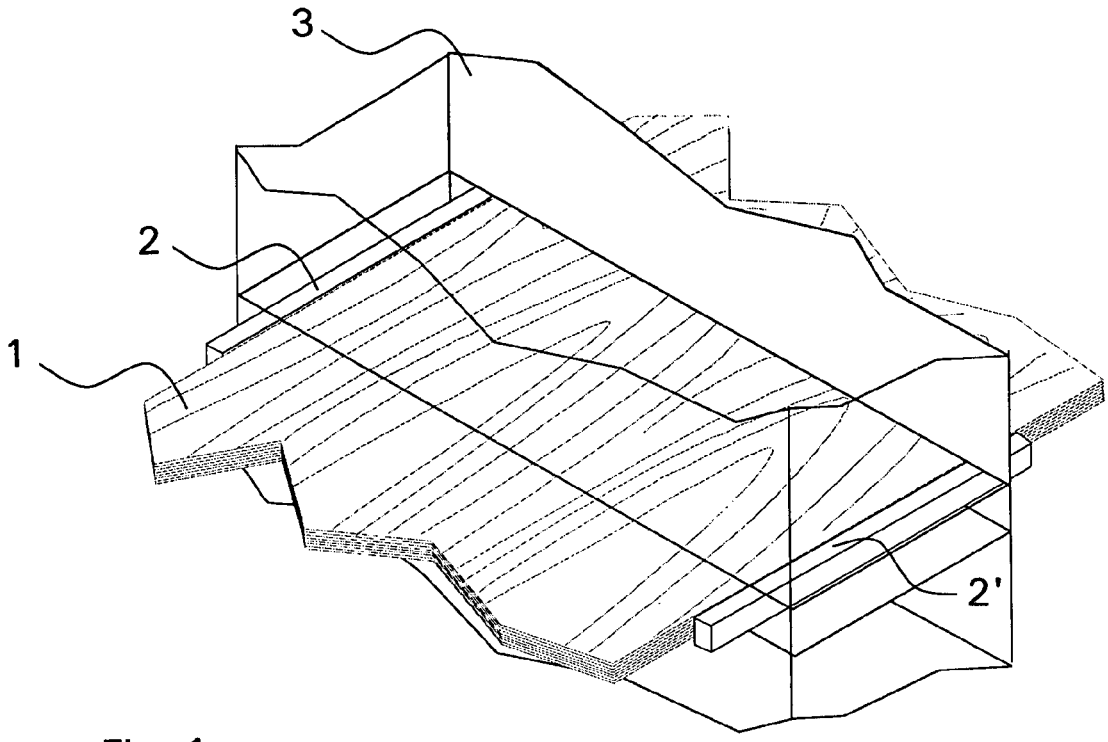

The present invention concerns an apparatus for heating a board product containing glued wood, primarily for affecting the hardening reactions of the glue, said apparatus applying the heating energy to the board product by means of an alternating electrical field at microwave frequency. Before the heating step, the board product has been manufactured to be continuous, and it is conveyed through a stationary heating apparatus. The board product generally comprises wood layers arranged parallel to the board, ply layers, the spaces between them being glued with glue to be hardened by means of heat. A typical product is the so-called LVL balk (Laminated Veneer Lumber). The invention is also applicable to other types of wood based board products, in which the glued wood component is bound to a solid board construction by hardening the glue. Before being transported to heating, the board product is usually exposed to pressure in order to get the glued wood components into a close contact and to remove air spaces disturbing the alternating electrical field in the board construction.

In an apparatus to be used for heating of this kind of a wood product, the alternating electrical energy is exerted to the board product to be heated perpendicular to the board plane, and the electrical field affecting the board has been formed by the device exerting the alternating electrical energy to the board so that the field affects in the plane of the board, in cross direction to the proceeding direction of the board. An alternating electrical field arranged in this way affects the material to be heated depending on its dielectric properties. For example the dielectric factor of the wood material of light and dry wood (moisture content 0%) is approximately 1.5 and respectively the loss tangent is approximately 0.02. With dense and damp wood (moisture content 100%) the dielectric constant is approximately 20 and respectively the loss tangent is about 0.25. On the average, with the sorts of wood to be used for board products, the respective values of dielectric constant range in the average humidity conditions from 2 to 4 and of loss tangent from 0.05 to 0.4. These values change to some extent, when the wood gets warm during the heating. With the glues used for board products these values are higher, for example dielectric values from 28 to 12 can be measured for phenol formaldehyde glue, whereby the higher value is received when the glue is in the room temperature and liquid. Thus, the heating effect of the alternating electric field is more efficient for the part of the glue. This effect appears advantageously especially with board products, in which the glue is applied as layers parallel with the board (parallel with the alternating electrical field).

The heating effect caused by the electric field is distributed to the area of the board coherently (taken into account the differences between the wood material and the glue), in case that the edges of the board are in contact with the walls of the device, the device being dimensioned according to the used frequency and the nominal width of the board. In praxis, however, there must be left a running clearance between the edges of the board parallel with the proceeding direction and the walls of the device. The air gap formed in this way, however, disturbs the formation of the alternating electrical field at its extreme ends, and as a result of that, the field at the edge areas of the board is formed narrower in the traveling direction of the board, and consequently the edges of the board get less of heating power, and the temperature remains lower than in the center areas of the board.

The problem mentioned above has been solved in accordance with the present invention by providing each of the gaps between the edges of the board parallel with the proceeding direction and the walls of the heating apparatus with a piece positioned to fill substantially clearance-free the actual gap, said slide piece being made of material having a small loss tangent and a low dielectric factor.

By means of the arrangement described above, the disturbance caused by the air gap in the formation of the electric field in the board product can be eliminated.

For the part of the dielectric properties of the material to be used for the slide piece, it must be taken into account, that in the alternating electric field it is practically free of losses, in other words, the loss tangent of the material is small and its dielectric constant has a very low value with frequencies of the alternating electric fields to be used. Standard frequency of the alternating electrical field in the heating apparatus in question is 915 MHz. Alternatively also a frequency of 2450 MHz can be considered.

A suitable value for the dielectric constant ranges from 1 to 10 and the loss tangent is about 0.02 or below this value. In addition, the sliding properties and/or abrasion strength of the material must be taken into account.

Suitable materials for the slides are different plastic materials and also ceramic materials having the above mentioned dielectric properties. Plastic materials include polytetrafluoroethylene (PTFE), polycarbonate (PC), polyphenylene sulfide (PPS), polyvinylidene fluoride (PVDF). Usable material and the dimensioning thereof as a slide can be chosen by modeling the form of the alternating electrical field to be implemented with it. Other applicable materials have been listed in Table 1 (appearing at the end of the specification), together with the loss tangent values of the materials.

One problem for implementing the apparatus is caused by the heat dissipating from the board to be heated to the slides, as well as the heat formed eventually in the slide material itself by the electric field, eventually making the temperature of the slide material to rise in use. The rise of the temperature can have influence on the durability of the material and also on its behavior in the alternating electrical field. These problems can appear pronouncedly in equipment configurations, where the slides are incorporated in the heating apparatus. When the slides are incorporated in the heating apparatus, the loss tangent of the material should not exceed the value 0.02.

The apparatus can alternatively be implemented so that the slide or a part thereof is formed as a band in a state of motion, following the board product to be heated pressed against its edge and sliding against the wall of the heating apparatus or a fixed part of the slide. In this embodiment the band-like slide or a part thereof can be advantageously implemented as a loop circulating along an endless path, the returning path thereof being located outside the heating apparatus. There the required cooling can be arranged for the slide band, said arrangement increasing the selection of suitable slide materials.

One embodiment of the apparatus in accordance with the present invention is shown schematically in FIG. 1 of the enclosed drawings.

Figure 2:
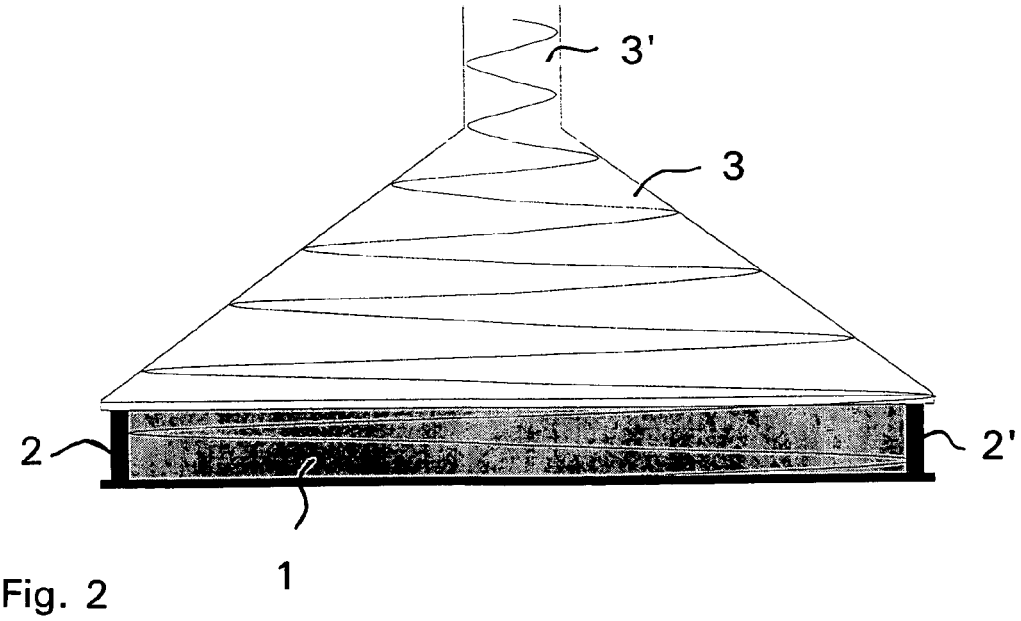
Figure 3:
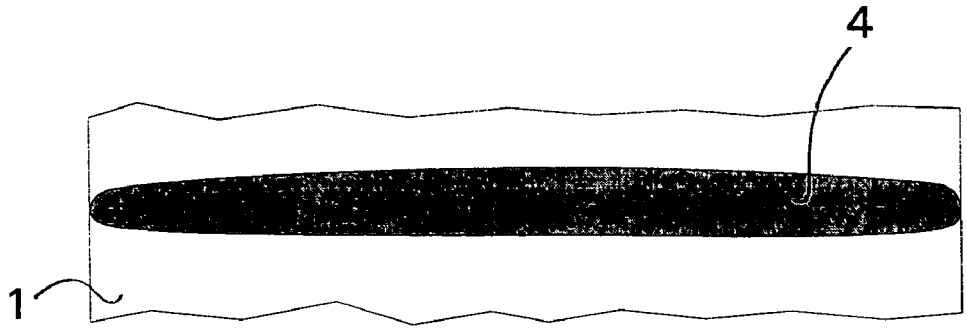
Figure 4:
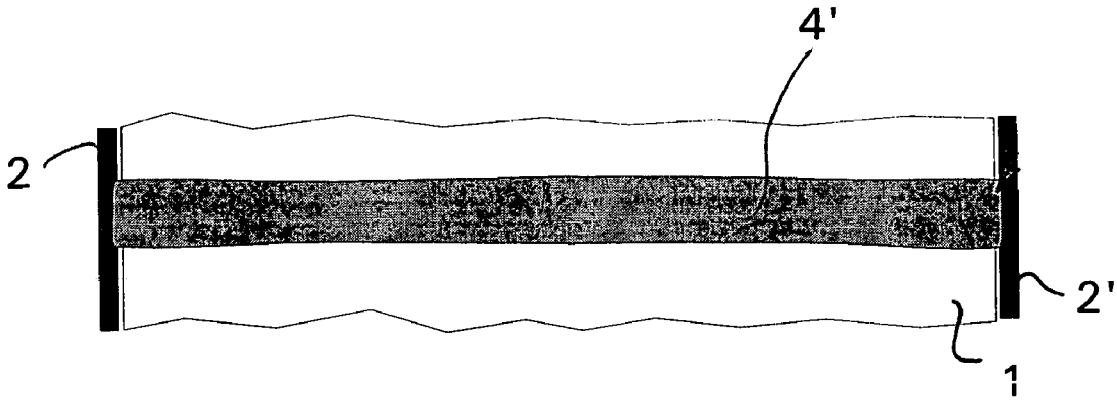

FIG. 2 is a cross sectional view against the proceeding direction of the board, of the same apparatus, FIG. 3 shows the form of the alternating electrical field affecting the board, as a view perpendicular to the board plane in an apparatus, wherein the edges of the board are at a distance of an air gap from the walls of the alternating electrical field chamber, and FIG. 4 shows a corresponding alternating electrical field, the form thereof being aligned by modifying measures of the apparatus in accordance with the invention.

In FIG. 1, the board product 1 to be heated is in a continuous proceeding motion through the chamber 3 of the heating apparatus. In the chamber, the board is exposed, perpendicular to its plane, to high-frequency alternating electric energy, which, by means of the dimensioning of said apparatus, can be made to maintain a alternating electrical field, the direction of which being at the plane of the board 1, transversal to its proceeding direction. Arranged between the side edges of the board 1 parallel to the proceeding direction and the walls of the chamber 3, there are slides 2 and 2', made of a material chosen to fulfill the properties as described above.

FIG. 2 shows a cross-sectional view of the board with respect to the proceeding direction of the board 1, showing the construction of a microwave chamber known in the art. The microwave energy to be exerted to the board 1 is applied from a wave slide 3' of a wave generator known in the art, for example at a frequency of 915 MHz. After the wave slide, the wave pattern is spread in an accurately dimensioned chamber 3 to stretch in the transversal direction of the board 1. In practice, a running clearance of a couple of millimeters must be left between the side walls of the chamber 3 and the side edges of the board 1, whereby the air gap present in this clearance disturbs the prevailing standing microwave pattern 4 in the board in accordance with FIG. 3, especially at the edges of the board.

By filling the clearance between the board 1 and the walls of the microwave chamber 3 with pieces 2, 2' made of a material having the right electrical properties, the prevailing microwave pattern in the board 1 will be formed to a pattern 4' corresponding the dimensioning of chamber 3, said pattern 4' shown in FIG. 4.

TABLE A

| Material | Loss tangent |
|---|---|
| OM (polyacetal) | 0.0011–0.007 |
| POM-C (POM copolymer) | equal |
| POM-H (POM homopolymer) | equal |
| POM-H-PTFE | equal |
| PC (polycarbonate) | 0.0006–0.0015 |
| PETP (polyethylene terephtalat) | 0.002 |
| PEEK (polyethylene - ethylene keton) | 0.001–0.004 |
| PEEK-GF30 (fiber glass 30%) | 0.001–0.004 |
| PPS (polyphenylene sulfide) | 0.0004 |
| PEI (polyether imide) | 0.014 |
| PSU (polysulphone) | 0.0008 |
| PI (polyimide) | 0.005 |
| PE (polyethylene) | 0.00015–0.0007 |
| PP (polypropylene) | 0.00007–0.0001 |
| EVA (ethylene vinyl acetate) | 0.0015 |
| PB (polybutene) | 0.0007–0.001 |
| PMP (poly-4-methylicpentene-1) | 0.00007 |
| PS (polystyrene) | 0.0001–0.0004 |
| SB, S, B (styrene, butadiene) | 0.0001–0.0005 |
| SAN (styrene/acrylonitrile) | 0.004–0.005 |
| ASA (acrylonitrile/styrene/acrylate) | 0.009 |
| PTFE (polytetrafluoroethylene) | 0.00003–0.00007 |
| FEP (perfluoride ethylene propylene) | 0.00003–0.00007 |
| PFA (perfluoride alkoxide polymer) | 0.00009 |
| ETFE (ethylene/tetrafluoroethylene) | 0.0006–0.005 |
| PCTFE (polychlorotrifluoroethylene) | 0.001–0.01 |
| ECTFE (ethylene/chlorotrifluoroethylene copolymer) | 0.001–0.01 |
| PBTP (polybutylenterephthalat) | 0.0012–0.002 |
| PPO (polyphenyl oxide) | 0.0004 |
| PES (polyether sulphone) | 0.0008–0.001 |

TABLE A-continued

| | Loss tangent |
|---|---|
| EP (epoxy) | 0.001 |
| CA (cellulose acetate) | 0.007–0.013 |
| CAB (cellulose acetate butyrate) | 0.005 |
| CP (cellulose propionate) | 0.005–0.007 |
| Composites: | |
| G-Etronax EP FR 4 (glass fiber laminate) | 0.005–0.008 |
| G-Etronax EP 11 (glass fiber laminate) | 0.008–0.01 |
| G-Etronax EP 215 S (glass fiber laminate) | 0.008–0.01 |
| G-Etronax EP S1 (glass fiber laminate) | 0.003 |
| C-STOCK RE (polyimide-based) | 0.0004–0.0009 |
| C-FOAM PK (polyurethane-based) | 0.001 |
| C-FOAM PF (polyolefin-based) | 0.0001 |
| C-CAST 235D (polystyrene-based) | 0.002 |
| C-STOCK.0005 | 0.0005 |
| ECFG | 0.007 |
| OASIS 300TWN525 (polyimide + fluoropolymer) | 0.01 |
| DiClad 522, 527 (woven glass fiber/Teflon) | 0.001–0.0022 |
| DiClad 870 (woven glass fiber/Teflon) | 0.0009–0.0013 |
| DiClad 880 (woven glass fiber/Teflon) | 0.0008–0.0013 |
| ROHACELL 31 (polymer, polymethacrylimide) | 0.0001–0.0004 |
| ROHACELL 51 (polymer, polymethacrylimide) | 0.0002–0.0004 |
| ROHACELL 71 (polymer, polymethacrylimide) | 0.0003–0.0007 |
| ROHACELL 110 (polymer, polymethacrylimide) | 0.0003–0.0007 |
| CuClad 250GT/GX (woven glass fiber/Teflon) | 0.001–0.0022 |
| CuClad 233LX (woven glass fiber/Teflon) | 0.0013 |
| CuClad 217LX (woven glass fiber/Teflon) | 0.0009 |
| AR320 | 0.0029 |
| IsoClad 933 (non-woven glass fiber/Teflon) | 0.0014 |
| IsoClad 917 (non-woven glass fiber/Teflon) | 0.0010 |
| DiClad 810 (ceramic filled Teflon) | 0.0020 |
| Epsilam 10 (ceramic filled Teflon) | 0.0029 |
| AR 1000 (ceramic filled Teflon) | 0.0035 |
| AR 600 (ceramic filled Teflon) | 0.0035 |
| AR 450 (ceramic filled Teflon) | 0.0026 |
| AR 350 (ceramic filled Teflon) | 0.0026 |
| CLTE (ceramic filled Teflon) | 0.0025 |

The invention claimed is:

1. An apparatus for heating a board product containing glued wood, said apparatus comprising:

a heating chamber through which the board product passes, wherein said heating chamber contains a wave spreader arranged to apply a microwave frequency energy from a wave generator in a direction perpendicular to a board plane of the board product, said board plane being transverse to planes corresponding to edges of said board product, and wherein said wave spreader is arranged to spread a wave pattern of the microwave frequency energy such that the wave pattern stretches in a direction transverse to the direction in which the board product passes through the heating chamber; and slide pieces substantially filling running clearances between respective side edges of the board and side walls of the heating chamber, wherein the slide pieces are made of a material having a small loss tangent and a low dielectric factor.

2. An apparatus according to claim 1, wherein the frequency of the heating electrical field fed to the chamber is alternatively 915 MHz or 2450 MHz, wherein the dielectric constant of the material of the slide pieces ranges from 1 to 10 and the loss tangent is $\leqq 0.02$.

3. An apparatus according to claim 2, wherein the material of the slide pieces is selected from the group: polytetrafluoroethylene (PTFE), polycarbonate (PC), polyphenylene sulfide (PPS), polyvinylidene fluoride (PVDF) and ceramic material.

4. An apparatus according to claim 2, wherein the slide pieces are incorporated with the side walls of the heating chamber.

5. An apparatus according to claim 2, wherein the slide pieces or parts of the slide pieces are movable in the direction in which the board product passes through the heating chamber.

6. An apparatus according to claim 1, wherein the material of the slide pieces is selected from the group consisting of: polytetrafluoroethylene (PTFE), polycarbonate (PC), polyphenylene sulfide (PPS), polyvinylidene fluoride (PVDF) and ceramic material.

7. An apparatus according to claim 6, wherein the slide pieces are incorporated with the side walls of the heating chamber.

8. An apparatus according to claim 6, wherein the slide pieces or parts of the slide pieces are movable in the direction in which the board product passes through the heating chamber.

9. An apparatus according to claim 1, wherein the slide pieces are incorporated with the side walls of the heating chamber.

10. An apparatus according to claim 9, wherein the loss tangent of the material of the slide pieces is $\leqq 0.002$.

11. An apparatus according to claim 1, wherein the slide pieces or parts of the slide pieces are movable in the direction in which the board product passes through the heating chamber.

* * * * *